United States Patent [19]

Schenke et al.

[11] Patent Number: 4,680,683

[45] Date of Patent: Jul. 14, 1987

[54] BATTERY AND BULB CONVERSION CARTRIDGE FOR SELF-FEEDING CANDLE HOLDER

[76] Inventors: Robert W. Schenke, P.O. Box 271; Reynold A. Schenke, P.O. Box 59, both of Paradise, Pa. 17562

[21] Appl. No.: 869,324

[22] Filed: Jun. 2, 1986

[51] Int. Cl.[4] ..... F21L 7/00

[52] U.S. Cl. ..... 362/190; 362/203; 362/810; 431/125; 431/290

[58] Field of Search ..... 431/125, 126, 288, 290; 362/202, 203, 205, 206, 810, 190

[56] References Cited

U.S. PATENT DOCUMENTS

| | | | |
|---|---|---|---|
| 1,299,537 | 4/1919 | Aungst | 431/290 |
| 2,469,163 | 5/1949 | Gilmere | 431/125 |
| 2,480,333 | 8/1949 | McClory | 431/290 |
| 2,831,331 | 4/1958 | Rodman | 431/125 |
| 3,194,955 | 7/1965 | Koch | 362/202 |
| 3,340,391 | 9/1967 | Heyden | 362/203 X |
| 3,416,871 | 12/1968 | Dragon | 431/125 |
| 3,614,279 | 10/1971 | Schenke | 431/126 X |

FOREIGN PATENT DOCUMENTS

| | | | |
|---|---|---|---|
| 525823 | 9/1921 | France | 362/203 |

*Primary Examiner*—Margaret A. Focarino
*Attorney, Agent, or Firm*—Harvey B. Jacobson

[57] ABSTRACT

A tubular conversion cartridge is provided for the outer tubular member of a self-feeding consumable candle holder and may be utilized to replace the consumable candle follower and guide sleeve within the outer tubular member of the holder in order to convert the holder into an electrically actuated simulated candle.

3 Claims, 3 Drawing Figures

BATTERY AND BULB CONVERSION CARTRIDGE FOR SELF-FEEDING CANDLE HOLDER

BACKGROUND OF THE INVENTION

1. Field of the Invention

This invention relates to an apparatus by which a tubular candle holder for continuously upwardly feeding a consumable candle may be converted into a battery actuated electric candle.

2. Description of Related Art

Various different forms of automatic feeding tubular holders for consumable candles heretofore have been provided such as those disclosed in U.S. Pat. Nos. 1,299,537, 1,908,044, 1,923,826, 2,464,361, 2,469,163, 3,283,546, 3,388,960 and 3,614,279. However, it is occasionally desired, for various reasons, not to use a consumable candle. One such reason would be in the event a candle is to be used in an area experiencing at least a moderate draft, such a draft causing a consumable candle to flicker excessively. In such an instance, it is sometimes desired to utilize an electrically actuated artificial candle in order that a candlelight atmosphere may be simulated without excessive flickering of the light source. Accordingly, a need exists by which a tubular holder for a consumable self-feeding candle may be retrofitted in order to convert the candle holder into an electrically actuated battery powered candle.

SUMMARY OF THE INVENTION

A conventional tubular holder for a self-feeding consumable candle includes an upstanding outer member having a tapered upper end defining an upper axial opening therein and the interior of the outer tubular member includes a coiled compression spring for applying an upward thrust on the lower end of a consumable candle disposed within the outer tubular member and having its upper end abutted against the internal surfaces of the tapered upper end of the outer tubular member about the axial opening defined at the upper end thereof and with the wick of the consumable candle projecting outwardly through the opening. The conversion cartridge of the instant invention is utilized in lieu of the consumable candle within a candle holder and the cartridge comprises an inner tubular member for reception within the candle holder outer tubular member in lieu of the consumable candle. The upper end of the cartridge supports a removable light bulb and the lower end of the cartridge contains storage battery means, the compression spring of the holder being utilized as a part of the electric circuit for electrically connecting the storage battery means to the bulb.

The main object of this invention is to provide a conversion cartridge whereby a tubular candle holder of the self-feeding type for consumable candles may be converted to an electrically actuated simulated candle.

Another object of this invention is to provide a conversion cartridge which may be utilized in conjunction with a conventional form of consumable candle holder indepedent of permanent modifications to the candle holder.

Still another important object of this invention is to provide a conversion cartridge in accordance with the preceding objects and which may be used in conjunction with different power candlelight simulating bulbs.

A final object of this invention to be specifically enumerated herein is to provide a conversion cartridge for a tubular candle holder of the type hereinabove discussed and which will conform to conventional forms of manufacture, be of simple construction a one-piece easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
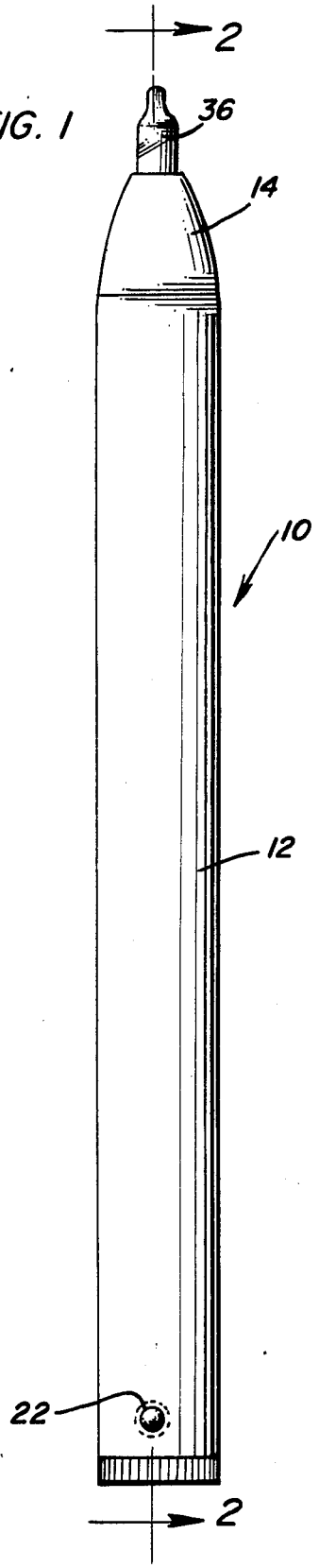
FIG. 1 is a side elevational view of a conventional form of a tubular candle holder for consumable candles and of the self-feeding type and which has been converted to an electric candle through utilization of the conversion cartridge of the instant invention.
Figure 2:
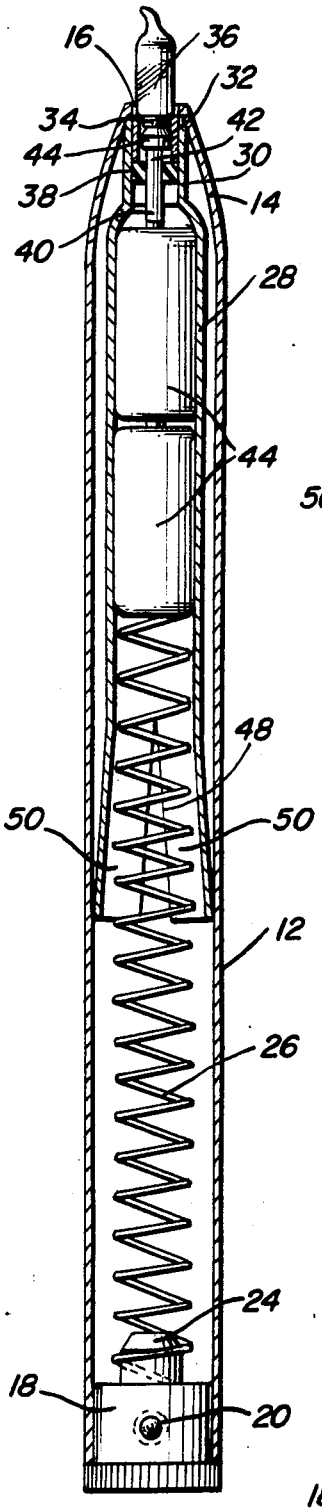
FIG. 2 is a vertical sectional view is taken substantially upon a plane indicated by the section line of 2—2 of FIG. 1.
Figure 2:
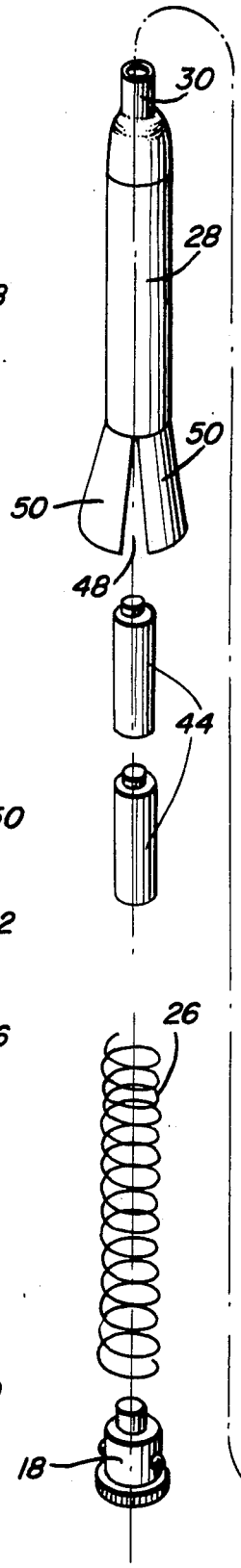
Figure 3:
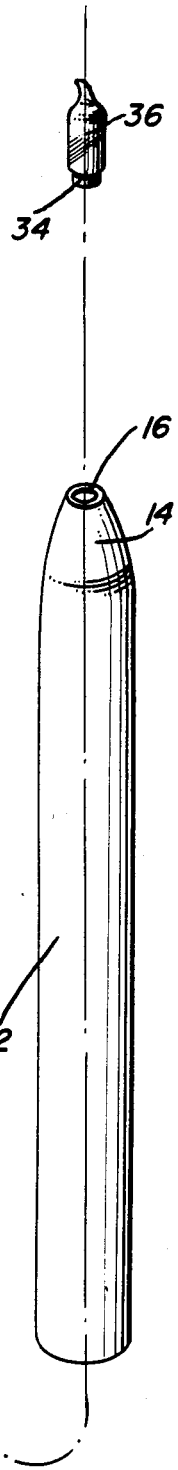
FIG. 3 is an exploded perspective view of the assemblage illustrated in FIGS. 1 and 2.

Referring now more specifically to the drawings, the numeral 10 generally designates a consumable candle holder of conventional design. The holder 10 includes an outer upstanding tubular member 12 including a tapered upper end 14 defining an upper end axial opening 16. In addition, a plug 18 removably closes the lower end of the tubular member 12 and is removably secured in position through the utilization of diametrically opposite spring biased detent balls 20 seated in diametrically opposite ports or openings 22 formed in the lower end of the tubular member 12. The plug 18 includes a diametrically reduced upwardly projecting center shank 24 over which the lower end of a coiled compression spring 26 is telescoped.

Originally, the interior of the tubular member 12 included an inner tubular member also having a tapered upper end seated against the inner services of the tapered upper end 14 below the opening 16 and through which a consumable candle is upwardly displaceable, the lower end of the candle having a follower supported therefrom loosely received in the inner tubular member and against which the upper end of the spring 26 abuts. With this construction, and only the wick of the consumable candle projecting upwardly through the opening, a consumable candle may be supported from the holder 10 and burned in a manner such that consumption of the burning upper end of the candle automatically results in the candle being upwardly fed through the holder 10 through utilization of the spring 26. In this manner, only the candle wick and flame thereof projects from the upper end of the holder 10.

However, when it is desired to utilize the holder 10 as an electrically actuated simulated candle, the original inner tubular member is removed as well as the consumable candle and follower and an inner tube 28 including a diametrically reduced upper end 30 is upwardly telescoped into the tubular member 12 through the open lower end thereof after the plug 18 has been removed. The upper end 30 abuts the inner surfaces of the tapered upper end 14 about and immediately below the opening 16 and supports a threaded tubular contact 32 therefrom into which the threaded base 34 of a candle flame simulating bulb 36 may be removably threaded. The contact 32 and inner tube 28 are constructed of electrically conductive material and are in electrical contact with each other. In addition, a centrally apertured dielectric partition 38 is disposed within the upper end 30 immediately below the contact 32 and slidingly receives the lower depending shank portion 40 of a center contact 42 therethrough including an upper end head 44 held captive above the partition 38. The center contact 42 is constructed of electrically conductive material and the lower end of the inner tube 28 supports a pair of end aligned and abutted storage batteries 44 therein, the spring 26 and plug 18 being installed within the lower end of the tubular member 12 beneath the batteries 44. The spring 26 serves to yieldingly upwardly bias the batteries 44 into electrical contact with the shank portion 40 and the lower end of the inner tube 28 includes diametrically opposite radial plane slits 48 formed therein and the diametrically opposite portions 50 of the lower terminal end of the inner tube 28 are spread apart and lightly, frictionally and slidably engage the inner surfaces of the tubular member 12 making electrical connections therewith.

When the bulb 36 is screwed into seated position within the contact 32 and makes electrical contact with the contact 42, the bulb 36 is disposed within a closed circuit including the batteries 44 and the electrically conductive plug 18, tubular member 12, inner tube 28 and the contact 32. Accordingly, the bulb 36 is electrically actuated. If it is desired to "turn off" the bulb 36, it is slightly unscrewed relative to the contact 32 so that contact between the lower end contact of the bulb 36 and the contact 42 is interrupted.

Accordingly, it may be seen that the conversion cartridge of the instant invention comprises the inner tube 28, the batteries 44, the contact 42 and the contact 32 in conjunction with the bulb 36. This cartridge may be inserted the tubular member 12 in lieu of the aforementioned consumable candle, follower and inner tubular member.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a simulated candle including a one-piece upstanding outer tubular member for receiving a consumable candle and having a tapered upper end defining a reduced diameter upper end axial opening with whose periphery the upper end outer periphery of a consumable candle may abut, an electrically conductive inner tube removably telescopingly received within said outer tubular member through the lower end thereof to a position spaced immediately below and abutted against the inner surfaces of said outer tubular member disposed below and about said opening, the upper end of said inner tube defining bulb base receiving socket means including relatively electrically insulated wall and center contact means constructed of electrically conductive material, a storage battery slidingly disposed in said inner tube and including an upper contact for electrical contact with said center contact means and an outer contact defining case relative to which said upper contact is insulated, a removable plug closing the lower end of said outer tubular member, electrically conductive compression spring means disposed within said outer tubular member above and contacting said plug and projecting upwardly into the lower end of said inner tube for engagement, while under compression, with said battery, the lower end of said spring being electrically connected to said outer tubular member, the lower end of said inner tube being frictionally electrically connected with said outer tubular member, said socket wall contact means being electrically connected to said inner tube, said inner tube being constructed of electrically conductive material and the upper end of said inner tube being abutted against and in electrical contact with the inner surfaces of said outer tubular merber disposed below and about said opening, said inner tube and spring, upon removal of said plug, being removable from the lower end of said outer tubular member, the lower end of said inner tube including outwardly flared portions by which said innter tube is frictionally electrically and slidably frictionally engaged with the opposing inner surfades of said outer tubular member, the upper end of said inner tube comprising a diametrically reduced portion of said inner tube, said battery being received within said inner tube below said upper end thereof, said spring exerting an upward thrust on said battery with the upper end of the outer contact defining case of said battery electrically contacting the inner surfaces of the diametrically reduced portion of said inner tube.

2. The simulated candle of claim 1 wherein said plug and the lower end of said outer tubular member include coacting detent latch means removably securing said plug in said outer tubular member lower end.

3. The simulated candle of claim 1 wherein said center contact means includes an electrically conductive contact pin extending longitudinally of said inner tube upper end and insulatively supported therefrom for longitudinally shifting with respect thereto.

* * * * *